US010487451B2

(12) United States Patent
Lasik et al.

(10) Patent No.: US 10,487,451 B2
(45) Date of Patent: Nov. 26, 2019

(54) METHODS AND COMPOSITIONS FOR CLEANING PAPER MACHINE FABRICS

(71) Applicants: Dennis Z. Lasik, Cumming, GA (US); William F. Mullen, Cumming, GA (US)

(72) Inventors: Dennis Z. Lasik, Cumming, GA (US); William F. Mullen, Cumming, GA (US)

(73) Assignee: WEST END PRODUCTS, LLC, Alpharetta, GA (US)

( * ) Notice: Subject to any disclaimer, the term of this patent is extended or adjusted under 35 U.S.C. 154(b) by 0 days.

(21) Appl. No.: 15/954,073

(22) Filed: Apr. 16, 2018

(65) Prior Publication Data

US 2018/0230651 A1 Aug. 16, 2018

Related U.S. Application Data

(62) Division of application No. 15/222,551, filed on Jul. 28, 2016, now Pat. No. 9,945,074.

(60) Provisional application No. 62/197,969, filed on Jul. 28, 2015.

(51) Int. Cl.
*D21F 1/32* (2006.01)
*C11D 7/26* (2006.01)

(52) U.S. Cl.
CPC ..... *D21F 1/32* (2013.01); *C11D 7/261* (2013.01); *C11D 7/266* (2013.01)

(58) Field of Classification Search
USPC ..... 162/199
See application file for complete search history.

(56) References Cited

U.S. PATENT DOCUMENTS

| | | | | | |
|---|---|---|---|---|---|
| 5,802,648 | A * | 9/1998 | Neun | D21F 1/325 | 162/272 |
| 6,468,397 | B1 * | 10/2002 | Chuang | D21F 1/32 | 134/148 |
| 7,597,782 | B2 * | 10/2009 | Baker | D21F 1/325 | 134/184 |
| 8,828,917 | B2 * | 9/2014 | Rieth | A61K 8/39 | 510/138 |
| 9,945,074 | B1 * | 4/2018 | Lasik | D21F 1/32 | |
| 2002/0072288 | A1 * | 6/2002 | Hei | A01N 25/02 | 442/59 |
| 2004/0040612 | A1 * | 3/2004 | Murakami | D21F 1/0027 | 139/383 R |
| 2012/0040880 | A1 * | 2/2012 | Rieth | A61K 8/39 | 510/138 |
| 2012/0204916 | A1 * | 8/2012 | Laser | C11D 3/2037 | 134/198 |
| 2014/0057820 | A1 * | 2/2014 | Lasik | C11D 7/34 | 510/109 |
| 2015/0038389 | A1 * | 2/2015 | De Wit | C11D 3/43 | 510/179 |
| 2015/0252302 | A1 * | 9/2015 | Rieth | C11D 3/2072 | 514/772 |

* cited by examiner

*Primary Examiner* — Mark Halpern
(74) *Attorney, Agent, or Firm* — Withers & Keys, LLC

(57) ABSTRACT

Methods of cleaning papermaking fabrics are disclosed. Cleaning compositions for cleaning papermaking fabrics are also disclosed.

20 Claims, 1 Drawing Sheet

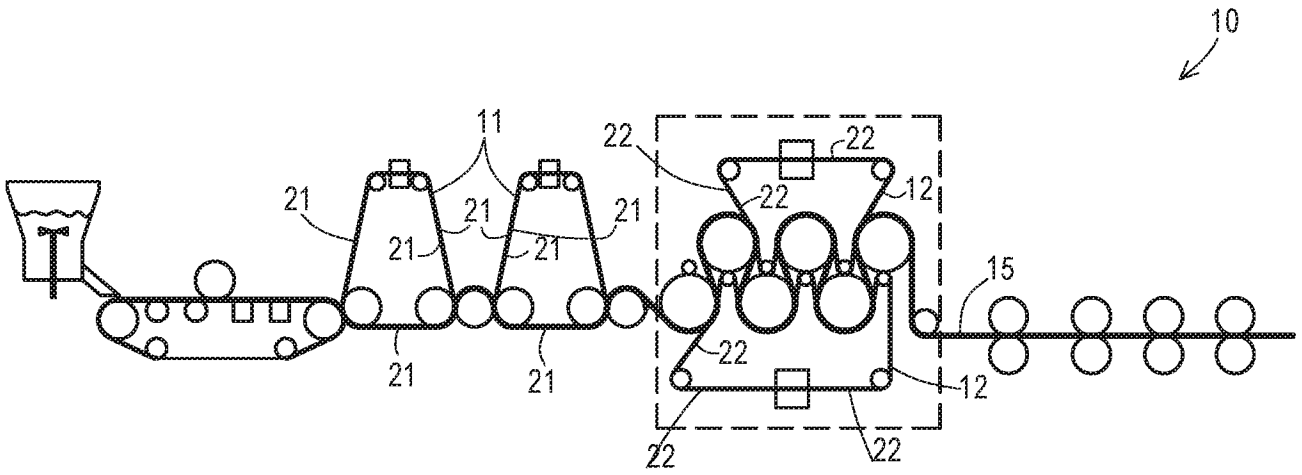
10
11
12
15
21
22

METHODS AND COMPOSITIONS FOR CLEANING PAPER MACHINE FABRICS

CROSS-REFERENCE TO RELATED APPLICATIONS

This patent application is a divisional patent application of U.S. Utility patent application Ser. No. 15/222,551 entitled "METHODS AND COMPOSITIONS FOR CLEANING PAPERMAKING FABRICS" filed on Jul. 28, 2016, now U.S. Pat. No. 9,945,074, which claims the benefit of priority to U.S. provisional patent application Ser. No. 62/197,969 entitled "METHODS AND COMPOSITIONS FOR CLEANING PAPER MACHINE FABRICS" filed on Jul. 28, 2015, the subject matter of both of which is incorporated herein in its entirety.

FIELD OF THE INVENTION

The present invention is directed to methods of cleaning paper machine fabrics (commonly known as felts and clothing, hereinafter "fabrics"), and cleaning compositions for use in the methods.

BACKGROUND OF THE INVENTION

Methods of cleaning papermaking fabrics are known. Traditional methods of cleaning papermaking fabrics include low and high pressure showering of wet end fabrics (i.e., fabrics used in forming and press sections of the papermaking process) and dry end fabrics (i.e., dryer fabrics). Wet end fabric cleaning may include, for example, two in-place showers used for each wet end fabric, namely, (1) a chemical application shower (hereinafter, "the wet application shower"), which typically operates at less than 100 psi pressure and is used for chemical application for cleaning the fabrics, both during machine operation (hereinafter "on the fly cleanings") and during nonoperational intervals (hereinafter "down batch cleanings"), and (2) a high pressure continuous cleaning oscillating shower bar, which typically runs from 150-550 psi (water only) (hereinafter, "the wet oscillating shower"). Water temperatures for the application shower and the oscillating shower are typically in the range of about 100-150° F.

Cleaning chemicals are typically introduced through either (i) the application shower, (ii) the oscillating shower, or (iii) both (i) and (ii). Chemicals are typically applied at either a highly caustic level (i.e., a pH of 9-13) or a mid-level acidic level (i.e., a pH of 3-5), each of which is labeled as hazardous. U.S. Pat. No. 7,597,782 assigned to DuBois Chemicals, Inc. (Sharonville, Ohio, USA) (hereinafter, "DuBois") describes using alternating acidic and caustic chemical batches delivered through an oscillating shower bar using an application pressure of from about 150-250 psi. Dubois sells a metering and delivery system called the DUPULSE™ system for this type of cleaning application.

For press fabrics, on the fly batch washes are generally done multiple times daily. Either (i) sheet handling problems or (ii) high Uhle box vacuum readings on the paper machines or (iii) other operational issues such as web breaks or poor moisture profiles force the operation to periodically stop the paper machine and perform a thorough down batch cleaning to alleviate the problem, again using either caustic or acidic cleaners. In addition, if the machine's operation is interrupted for other reasons, the personnel normally use that opportunity to perform a down batch cleaning of the fabrics.

Typically, press fabric life averages about 4 to 8 weeks using this type of cleaning system. At the end of the fabric life, the fabrics are removed from the machine and replaced with new fabrics.

In dryer fabric cleaning operations on many modern or updated paper machines, the early (i.e., first, second, and possibly more) dryer groups of the dryer section may be equipped with a single dryer fabric configured to serpentine around the top and bottom drying cylinders, commonly known as unirun(s) or unorun(s) fabrics. Later dryer groups, or those not equipped with a unirun fabric, are typically and more conventionally configured whereby the top and bottom drying cylinders are equipped with separate top and bottom fabrics. Because the early dryer groups are operated at a higher temperature (i.e., about 200° F.; significantly higher than the preceding press section), the paper web is subjected to a thermal shock that causes contaminants contained within the paper web to precipitate out and onto the dryer fabric(s); causing the contaminants to adhere to the surface of the dryer fabric. For this reason, these early dryer groups pose significant cleaning challenges to the papermaker. Further, given that the operation in this section is specifically aimed at removing moisture dryer sections, by necessity avoid adding water to this stage of the operation.

There are three common types of showers in the unirun section:

(1) A low pressure chemical application shower (hereinafter, "the dryer application shower") that typically operates at less than 100 p.s.i. and is used when the paper machine is not in operation (i.e., down batch cleaning), and traditionally uses a caustic based chemical (i.e., usually one per unirun fabric).

(2) An oscillating, high pressure (500+ p.s.i.) shower (hereinafter, "the dryer oscillating shower") used when the paper machine is not in operation (i.e., down batch cleaning) and without the addition of cleaning chemicals. When present, the oscillating shower is often used for aiding in rinsing the fabric and lifting the contaminant during a down batch chemical cleaning (i.e., usually one per unirun fabric, but not always present).

(3) A very high pressure (i.e., 2500+ adjustable psi) continuous traversing needle shower (hereinafter, "the dryer needle shower") equipped with some type of evacuation mechanism (e.g., often vacuum assisted) for removing the water and contaminants from the fabric. This shower is less frequently present given that it is a fairly high cost capital item. When present, they are most frequently found in the early dryer groups. Traditionally, this type of shower has never been used to deliver chemical cleaners to the fabric. Various manufacturers make these types of showers.

On the fly cleanings are typically not done in the unirun section. Down batch cleaning cycles vary greatly depending on contaminant loading, but can be necessary as frequently as once per week. Web breaks, sheet handling issues, poor moisture profile, embossing (marking) of the paper web (lower quality), and high steam/energy requirements are some of the reasons for stopping the machine to clean the dryer fabric(s). Using the chemical application shower, caustic based washing chemicals are typically used (i.e., a pH 9-13). Typically, extra rinsing time is required because the caustic, if left on the fabric, causes degradation of the fabric yarns and seam, and can drastically decrease the life of the fabric. Because of the hazardous nature of the cleaners, chemical vendors are often on site to handle the cleanings.

There exists a need in the art for less hazardous and more efficient methods of cleaning papermaking fabrics.

SUMMARY OF THE INVENTION

The present invention relates to the discovery of improved methods of cleaning paper machine clothing. The disclosed methods and cleaning compositions enable efficient cleaning of papermaking fabrics, while eliminating the hazards associated with highly acidic and caustic compositions.

The present invention is directed to methods of cleaning papermaking fabrics. In one exemplary embodiment, the method of cleaning a papermaking fabric comprises a method of cleaning one or more papermaking fabrics, said method comprising: contacting a wet end papermaking fabric(s) with a first cleaning composition having a first application pressure of at least 150 psi during a fabric cleaning step, the first cleaning composition comprising water and at least one other cleaning component. In some embodiments, the first cleaning composition comprising water and at least one other cleaning component selected from: one or more aliphatic dibasic acid esters, one or more aromatic alcohols, one or more alkyl fatty esters, one or more alkylene carbonates, one or more methyl soyates, one or more surfactants, one or more glycols, a dioctyl sulfosuccinate sodium salt (DOSS), a defoamer, a fragrance, and combinations thereof.

In another exemplary embodiment, the method of cleaning a papermaking fabric comprises a method of cleaning one or more papermaking fabrics, said method comprising: contacting a dry end papermaking fabric with a second cleaning composition having a second application pressure of at least 150 psi during a dry end fabric cleaning step, the second cleaning composition comprising water and at least one other cleaning component. In some embodiments, the second cleaning composition comprising water and at least one other cleaning component selected from: one or more aliphatic dibasic acid esters, one or more alkylene carbonates, one or more methyl soyates, one or more aromatic alcohols, one or more alkyl fatty esters, one or more surfactants, one or more glycols, a dioctyl sulfosuccinate sodium salt (DOSS), a defoamer, a fragrance, and combinations thereof.

In yet another exemplary embodiment, the method of cleaning a papermaking fabric comprises a method of cleaning one or more papermaking fabrics, said method comprising: contacting (i) a wet end papermaking fabric with a first cleaning composition during a wet end fabric cleaning step, (ii) a dry end papermaking fabric with a second cleaning composition during a dry end fabric cleaning step, or (iii) both a wet end papermaking fabric with a first cleaning composition during a wet end fabric cleaning step, and a dry end papermaking fabric with a second cleaning composition during a dry end fabric cleaning step, wherein, when present, each of the first and second cleaning compositions comprises a pH near neutral chemical composition (i) having a composition pH ranging from about 5.0 to about 8.0, and (i) comprising water and at least one other cleaning component. In some embodiments, each of the first and/or second cleaning compositions independently comprises water and at least one other cleaning component selected from: one or more aliphatic dibasic acid esters, one or more aromatic alcohols, one or more alkyl fatty esters, one or more alkylene carbonates, one or more methyl soyates, one or more surfactants, one or more glycols, a dioctyl sulfosuccinate sodium salt (DOSS), a defoamer, a fragrance, and combinations thereof.

The present invention is further directed to cleaning compositions suitable for use in the herein-described methods. In one exemplary embodiment, the cleaning composition comprises an aromatic alcohol, at least one aliphatic dibasic ester, and water. In another exemplary embodiment, the cleaning composition comprises one or more alkylene carbonates, a glycol, and at least one of: an aromatic alcohol, at least one aliphatic dibasic ester, one or more methyl soyates, one or more surfactants, and water. Any of the herein-described cleaning compositions of the present invention may further comprise one or more of the following additional components: one or more surfactants, a defoamer; a glycol; a dioctyl sulfosuccinate sodium salt (DOSS); an optional additional solvent component; and an optional fragrance.

These and other features and advantages of the present invention will become apparent after a review of the following detailed description of the disclosed embodiments and the appended claims.

BRIEF DESCRIPTION OF THE FIGURES

The present invention is further described with reference to the appended FIGURE, wherein:

FIG. 1 depicts an exemplary paper making machine and its use in preparing paper utilizing the methods of the present invention.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to methods of cleaning papermaking fabrics. The present invention is also directed to cleaning compositions for use in the herein-described methods.

Embodiments of the present invention are further described below.

Additional Embodiments

Methods of Cleaning One or More Papermaking Fabrics

1. A method of cleaning one or more papermaking fabrics 11/12, said method comprising: contacting a wet end papermaking fabric 11 with a first cleaning composition having a first application pressure of at least 150 psi during a wet end fabric cleaning step, the first cleaning composition comprising water and at least one other cleaning component. The first application pressure may be 150 psi, or any value above 150 psi, in increments of 0.1 psi, for example, 352.1 psi, or any range of values above 150 psi, in increments of 0.1 psi, for example, from about 165.0 to about 525.2 psi. In some embodiments, the first cleaning composition comprising water and at least one other cleaning component selected from: one or more aliphatic (i.e., linear and/or branched) dibasic acid esters, one or more alkylene carbonates (e.g., propylene carbonate), one or more methyl soyates, one or more aromatic alcohols (e.g., benzyl alcohol), one or more alkyl (i.e., linear and/or branched) fatty esters, one or more surfactants (e.g., $C_8$-$C_{12}$ linear alkoxylated alcohols), one or more glycols (e.g., dipropylene glycol), a dioctyl sulfosuccinate sodium salt (DOSS), a defoamer, a fragrance, and combinations thereof. As used herein, the term "methyl soyate" is used to refer to methyl esters derived from soybean oil. Methyl soyate may comprise a blend of methyl esters, such as a blend of two or more of: palmitic acid methyl ester, stearic acid methyl ester, oleic acid methyl ester, linoleic acid methyl ester, and linolenic acid methyl ester. Methyl soyate is commercially available from a number of sources including, but not limited to, Soy Technologies, LLC (Nicholasville, Ky.). Soy Technologies, LLC sells a number of methyl soyates under the following trade designations: SOYANOL™ 1000E, SOYANOL™ 5000E, SOYANOL™ 5000X-HS, SOYANOL™ 5000X-X, SOYANOL™ 5000X-TB, and SOYANOL™ SGE40. Further, as used herein, the phrase "aliphatic dibasic acid esters" refers to both linear and/or branched aliphatic dibasic acid esters.

2. The method of embodiment 1, wherein the first application pressure is at least about 250 psi during the wet end fabric cleaning step. The first application pressure may be 250 psi, or any value above 250 psi, in increments of 0.1 psi, for example, 352.1 psi, or any range of values above 250 psi, in increments of 0.1 psi, for example, from about 250.0 to about 350.2 psi.

3. The method of embodiment 1 or 2, wherein the first application pressure is from about 250 psi to about 600 psi during the wet end fabric cleaning step. The first application pressure may be 250 psi or 600 psi, or any value between 250 and 600 psi, in increments of 0.1 psi, for example, 352.1 psi, or any range of values between 250 and 600 psi, in increments of 0.1 psi, for example, from about 365.0 to about 550.2 psi.

4. The method of any one of embodiments 1 to 3, wherein the first cleaning composition is applied via one or more of: (i) stationery shower heads, (ii) oscillating shower heads, or (iii) a combination of stationery shower heads and oscillating shower heads. Any one of the (i) stationery shower heads and (ii) oscillating shower heads may be present at one or more locations along an outer surface of the wet end papermaking fabric 11. Possible locations include, but are not limited to, locations 21 shown in FIG. 1.

5. The method of any one of embodiments 1 to 4, wherein the first cleaning composition is applied via one or more stationery shower heads.

6. The method of any one of embodiments 1 to 5, wherein the first cleaning composition is also applied via one or more stationery shower heads during a wet application shower cleaning step. The phrase "a wet application shower cleaning step" is used to describe a chemical application (i.e., other than simply water) using one or more stationary shower heads during a wet end cleaning step. The chemical application can be applied at a relatively low pressure, e.g., about 100 psi, or may be applied at a higher application pressure, typically, less than about 500 psi, and as low as about 30 psi (or any value between 30 and 500 psi, in increments of 0.1 psi, for example, about 100.1 psi, or any range of values between about 30 and about 500 psi, in increments of 0.1 psi, for example, from about 30.0 to about 50.0 psi).

7. The method of any one of embodiments 1 to 6, wherein the first cleaning composition is applied via one or more oscillating shower heads.

8. The method of any one of embodiments 1 to 7, wherein the first cleaning composition is applied via one or more oscillating shower heads during a wet oscillating shower cleaning step. The phrase "a wet oscillating shower cleaning step" is used to describe a chemical application (i.e., water or a composition other than simply water, such as the first cleaning composition in this embodiment) using one or more oscillating shower heads during a wet end cleaning step. The chemical application is typically applied at a higher application pressure, typically, from about 250 psi to about 550 psi.

9. The method of any one of embodiments 1 to 8, wherein the first cleaning composition is applied via a combination of stationery shower heads and oscillating shower heads.

10. The method of any one of embodiments 1 to 9, wherein the first cleaning composition is a pH near neutral chemical composition, having a composition pH ranging from about 5.0 to about 8.0 (or any pH between about 5.0 and about 8.0, in increments of 0.1, for example, about 5.3, or any range of values between about 5.0 and about 8.0, in increments of 0.1, for example, from about 5.4 to about 7.5).

11. The method of any one of embodiments 1 to 10, wherein the first cleaning composition is a pH near neutral chemical composition, having a composition pH ranging from about 6.5 to about 7.5.

12. The method of any one of embodiments 1 to 11, wherein the first cleaning composition is applied at a first fluid feed rate that varies depending on (i) a basis weight of product 15 (e.g., paper or paper stock) moving along the wet end papermaking fabric 11, (ii) a line speed of the product 15 along the wet end papermaking fabric 11, or (iii) both the basis weight of the product 15 moving along the wet end papermaking fabric 11, and the line speed of the product 15 along the wet end papermaking fabric 11.

13. The method of any one of embodiments 1 to 12, wherein said method eliminates a need for down batch cleanings during the wet end fabric cleaning step.

14. The method of any one of embodiments 1 to 13, said method further comprising: contacting a dry end papermaking fabric 12 with a second cleaning composition having a second application pressure of at least 150 psi during a dry end fabric cleaning step, the second cleaning composition comprising water and at least one other cleaning component. In some embodiments, the second cleaning composition comprising water and at least one other cleaning component selected from: one or more aliphatic dibasic acid esters, one or more alkylene carbonates, one or more methyl soyates, one or more aromatic alcohols, one or more alkyl fatty esters, one or more surfactants, one or more glycols, a dioctyl sulfosuccinate sodium salt (DOSS), a defoamer, a fragrance, and combinations thereof. The second application pressure may be 150 psi, or any value above 150 psi, in increments of 0.1 psi, for example, 352.1 psi, or any range of values above 150 psi, in increments of 0.1 psi, for example, from about 165.0 to about 6000.0 psi.

15. The method of embodiment 14, wherein the second application pressure of at least about 250 psi during the dry end fabric cleaning step. The second application pressure may be 250 psi, or any value above 250 psi, in increments of 0.1 psi, for example, 252.1 psi, or any range of values above 250 psi, in increments of 0.1 psi, for example, from about 365.0 to, for example, about 6000.0 psi.

16. The method of embodiment 14 or 15, wherein the second application pressure of from about 2500 psi to about 6000 psi during the dry end fabric cleaning step. The second application pressure may be any value between about 2500 psi to about 6000 psi, in increments of 0.1 psi, for example, 2500.1 psi, or any range of values between about 2500 psi to about 6000 psi, in increments of 0.1 psi, for example, from about 2500.0 to about 4500.0 psi (or more typically, from about 2500.0 to about 3500.0 psi).

17. The method of any one of embodiments 14 to 16, wherein the second cleaning composition is applied via one or more of: (i) stationery shower heads, (ii) oscillating shower heads, (iii) a traversing needle shower, or (iv) a combination of stationery shower heads, oscillating shower heads, and a traversing needle shower head. Any one of the (i) stationery shower heads and (ii) oscillating shower heads may be present at one or more locations along an outer surface of the dry end papermaking fabric 12. Possible locations include, but are not limited to, locations 22 shown in FIG. 1.
18. The method of any one of embodiments 14 to 17, wherein the second cleaning composition is applied via one or more stationery shower heads.
19. The method of any one of embodiments 14 to 18, wherein the second cleaning composition is applied via one or more stationery shower heads during a dryer application shower cleaning step. The phrase "a dryer application shower cleaning step" is used to describe a chemical application (i.e., other than simply water) using one or more stationary shower heads during a dryer end cleaning step. The chemical application can be applied at a relatively low pressure, e.g., about 100 psi, or may be applied at a higher application pressure, typically, less than about 500 psi, and as low as about 30.0 psi (or any value between 30.0 and 500.0 psi, in increments of 0.1 psi, for example, 100.1 psi, or any range of values between 30 and 500 psi, in increments of 0.1 psi, for example, from about 250.0 to about 350.0 psi).
20. The method of any one of embodiments 14 to 19, wherein the second cleaning composition is applied via one or more oscillating shower heads.
21. The method of any one of embodiments 14 to 20, wherein the second cleaning composition is applied via one or more oscillating shower heads during a dryer oscillating shower cleaning step. The phrase "a dryer oscillating shower cleaning step" is used to describe a chemical application (i.e., water or a composition other than simply water, such as the second cleaning composition in this embodiment) using one or more oscillating shower heads during a dryer end cleaning step. The chemical application is typically applied at a higher application pressure, typically, from about 250 psi to about 550 psi (or more typically, from about 250 psi to about 350 psi, or possibly from about 250 psi to about 350 psi).
22. The method of any one of embodiments 14 to 21, wherein the second cleaning composition is applied via a traversing needle shower head.
23. The method of any one of embodiments 14 to 22, wherein the second cleaning composition is applied via a traversing needle shower head during a dryer needle shower cleaning step. The phrase "a dryer needle shower cleaning step" is used to describe a chemical application (i.e., water or a composition other than simply water, such as the second cleaning composition in this embodiment) using one or more traversing needle shower heads at a very high pressure, typically, greater than 2500 psi, equipped with some type of evacuation mechanism (e.g., often vacuum assisted) for removing water and contaminants from the fabric.
24. The method of any one of embodiments 14 to 23, wherein the second cleaning composition is applied via a combination of stationery shower heads, oscillating shower heads, and a traversing needle shower head.
25. The method of any one of embodiments 14 to 24, wherein the second cleaning composition is a pH near neutral chemical composition, having a composition pH ranging from about 5.0 to about 8.0. The composition pH may be any value between about 5.0 to about 8.0, in increments of 0.1, for example, 7.1, or any range of values between about 5.0 to about 8.0, in increments of 0.1, for example, from about 5.6 to about 7.4.
26. The method of any one of embodiments 14 to 25, wherein the second cleaning composition is a pH near neutral chemical composition, having a composition pH ranging from about 6.5 to about 7.5.
27. The method of any one of embodiments 14 to 26, wherein the second cleaning composition is applied at a second fluid feed rate that varies depending on (i) a basis weight of product 15 (e.g., paper or paper stock) moving along the dry end papermaking fabric 12, (ii) a line speed of the product 15 along the dry end papermaking fabric 12, or (iii) both the basis weight of the product 15 moving along the dry end papermaking fabric 12, and the line speed of the product 15 along the dry end papermaking fabric 12.
28. The method of any one of embodiments 14 to 27, wherein the second cleaning composition is applied via an on-the-fly batch cleaning step.
29. The method of any one of embodiments 14 to 28, wherein the second cleaning composition is applied via an on-the-fly continuous cleaning step.
30. The method of any one of embodiments 14 to 29, wherein said method eliminates a need for down batch cleanings during the dry end fabric cleaning step.
31. A method of cleaning one or more papermaking fabrics 11/12, said method comprising: contacting a dry end papermaking fabric 12 with a second cleaning composition having a second application pressure of at least 150 psi during a dry end fabric cleaning step, the second cleaning composition comprising water and at least one other cleaning component. In some embodiments, the second cleaning composition comprising water and at least one other cleaning component selected from: one or more aliphatic dibasic acid esters, one or more alkylene carbonates, one or more methyl soyates, one or more aromatic alcohols, one or more alkyl fatty esters, one or more surfactants, one or more glycols, a dioctyl sulfosuccinate sodium salt (DOSS), a defoamer, a fragrance, and combinations thereof. The second application pressure may be 150 psi, or any value above 150 psi, in increments of 0.1 psi, for example, 352.1 psi, or any range of values above 150 psi, in increments of 0.1 psi, for example, from about 165.0 to about 6000.0 psi.
32. The method of embodiment 31, wherein the second application pressure of at least about 250 psi during the dry end fabric cleaning step. The second application pressure may be 250 psi or any value above 250 psi, in increments of 0.1 psi, for example, 252.1 psi, or any range of values above 250 psi to, for example, about 6000 psi, in increments of 0.1 psi, for example, from about 365.0 to about 589.0 psi.
33. The method of embodiment 31 or 32, wherein the second application pressure of from about 2500 psi to about 6000 psi during the dry end fabric cleaning step. The second application pressure may be any value between about 2500 psi to about 6000 psi, in increments of 0.1 psi, for example, 2520.1 psi, or any range of values between about 2500 psi to about 6000 psi, in increments of 0.1 psi, for example, from about 3653.0 to about 5890.0 psi (or from about 2500.0 to about 4500.0 psi, or from about 2500.0 to about 3500.0 psi).

34. The method of any one of embodiments 31 to 33, wherein the second cleaning composition is applied via one or more of: (i) stationery shower heads, (ii) oscillating shower heads, (iii) a traversing needle shower head, or (iv) a combination of stationery shower heads, oscillating shower heads, and a traversing needle shower head.
35. The method of any one of embodiments 31 to 34, wherein the second cleaning composition is applied via one or more stationery shower heads.
36. The method of any one of embodiments 31 to 35, wherein the second cleaning composition is applied via one or more stationery shower heads during a dryer application shower cleaning step.
37. The method of any one of embodiments 31 to 36, wherein the second cleaning composition is applied via one or more oscillating shower heads.
38. The method of any one of embodiments 31 to 37, wherein the second cleaning composition is applied via one or more oscillating shower heads during a dryer oscillating shower cleaning step.
39. The method of any one of embodiments 31 to 38, wherein the second cleaning composition is applied via a traversing needle shower head.
40. The method of any one of embodiments 31 to 39, wherein the second cleaning composition is applied via a traversing needle shower during a dryer needle shower cleaning step.
41. The method of any one of embodiments 31 to 40, wherein the second cleaning composition is applied via a combination of stationery shower heads, oscillating shower heads, and a traversing needle shower head.
42. The method of any one of embodiments 31 to 41, wherein the second cleaning composition is a pH near neutral chemical composition, having a composition pH ranging from about 5.0 to about 8.0. The composition pH may be any value between about 5.0 to about 8.0, in increments of 0.1, for example, 7.1, or any range of values between about 5.0 to about 8.0, in increments of 0.1, for example, from about 7.0 to about 7.4.
43. The method of any one of embodiments 31 to 42, wherein the cleaning composition fluid is a pH near neutral chemical composition, having a composition pH ranging from about 6.5 to about 7.5.
44. The method of any one of embodiments 31 to 43, wherein the second cleaning composition is applied at a second fluid feed rate that varies depending on (i) a basis weight of product 15 (e.g., paper or paper stock) moving along the dry end papermaking fabric 12, (ii) a line speed of the product 15 along the dry end papermaking fabric 12, or (iii) both the basis weight of the product 15 moving along the dry end papermaking fabric 12, and the line speed of the product 15 along the dry end papermaking fabric 12.
45. The method of any one of embodiments 31 to 44, wherein the second cleaning composition is applied via an on-the-fly batch cleaning step.
46. The method of any one of embodiments 31 to 45, wherein the second cleaning composition is applied via an on-the-fly continuous cleaning step.
47. The method of any one of embodiments 31 to 46, wherein said method eliminates a need for down batch cleanings during the dry end fabric cleaning step.
48. A method of cleaning one or more papermaking fabrics 11/12, said method comprising: contacting (i) a wet end papermaking fabric 11 with a first cleaning composition during a wet end fabric cleaning step, (ii) a dry end papermaking fabric 12 with a second cleaning composition during a dry end fabric cleaning step, or (iii) both a wet end papermaking fabric 11 with a first cleaning composition during a wet end fabric cleaning step, and a dry end papermaking fabric 12 with a second cleaning composition during a dry end fabric cleaning step, wherein, when present, each of the first and second cleaning compositions comprises a pH near neutral chemical composition having a composition pH ranging from about 5.0 to about 8.0. The composition pH may be any value between about 5.0 to about 8.0, in increments of 0.1, for example, 7.1, or any range of values between about 5.0 to about 8.0, in increments of 0.1, for example, from about 7.0 to about 7.4 (or from about 5.3 to about 7.7, or from about 5.5 to about 7.5).
49. The method of embodiment 48, wherein, when present, each of the first and second cleaning compositions comprise a pH near neutral chemical composition having a composition pH ranging from about 5.5 to about 7.5.
50. The method of embodiment 48 or 49, said contacting step comprising contacting a wet end papermaking fabric 11 with a first cleaning composition having a first application pressure of at least 30 psi during the wet end fabric cleaning step. The first application pressure may be 30 psi, or any value above 30 psi, in increments of 0.1 psi, for example, 52.1 psi, or any range of values above 30 psi, in increments of 0.1 psi, for example, from about 165.0 to about 525.2 psi (or from about 30.0 psi to about 50.0 psi, or from about 40.0 psi to about 50.0 psi).
51. The method of any one of embodiments 48 to 50, wherein the first application pressure is at least about 250 psi during the wet end fabric cleaning step. The first application pressure may be 250 psi, or any value above 250 psi, in increments of 0.1 psi, for example, 352.1 psi, or any range of values above 250 psi, in increments of 0.1 psi, for example, from about 265.0 to about 525.2 psi (or from about 250.0 psi to about 400.0 psi, or from about 250.0 psi to about 350.0 psi).
52. The method of any one of embodiments 48 to 51, wherein the first application pressure is from about 250 psi to about 6000 psi during the wet end fabric cleaning step. The first application pressure may be 250 psi or 6000 psi, or any value between 250 and 6000 psi, in increments of 0.1 psi, for example, 352.1 psi, or any range of values between 250 and 6000 psi, in increments of 0.1 psi, for example, from about 365.0 to about 550.2 psi (or from about 250.0 psi to about 350.0 psi, or from about 2500.0 psi to about 4500.0 psi).
53. The method of any one of embodiments 48 to 52, wherein the first cleaning composition is applied via one or more of: (i) stationery shower heads, (ii) oscillating shower heads, or (iii) a combination of stationery shower heads and oscillating shower heads.
54. The method of any one of embodiments 48 to 53, wherein the first cleaning composition is applied via one or more stationery shower heads.
55. The method of any one of embodiments 48 to 54, wherein the first cleaning composition is applied via one or more stationery shower heads during a wet application shower cleaning step.
56. The method of any one of embodiments 48 to 55, wherein the first cleaning composition is applied via one or more oscillating shower heads.

57. The method of any one of embodiments 48 to 56, wherein the first cleaning composition is applied via one or more oscillating shower heads during a wet oscillating shower cleaning step.
58. The method of any one of embodiments 48 to 57, wherein the first cleaning composition is applied via a combination of stationery shower heads and oscillating shower heads.
59. The method of any one of embodiments 48 to 58, wherein the first cleaning composition is applied at a first fluid feed rate that varies depending on (i) a basis weight of product 15 (e.g., paper or paper stock) moving along the wet end papermaking fabric 11, (ii) a line speed of the product 15 along the wet end papermaking fabric 11, or (iii) both the basis weight of the product 15 moving along the wet end papermaking fabric 11, and the line speed of the product 15 along the wet end papermaking fabric 11.
60. The method of any one of embodiments 48 to 59, wherein said method eliminates a need for down batch cleanings during the wet end fabric cleaning step.
61. The method of any one of embodiments 48 to 60, said method further comprising: contacting a dry end papermaking fabric 12 with a second cleaning composition having a second application pressure of at least 30 psi during a dry end fabric cleaning step, the second cleaning composition comprising water and at least one other cleaning component. In some embodiments, the second cleaning composition comprising water and at least one other cleaning component selected from: one or more aliphatic dibasic acid esters, one or more alkylene carbonates, one or more aromatic alcohols, one or more alkyl fatty esters, one or more surfactants, one or more glycols, a dioctyl sulfosuccinate sodium salt (DOSS), a defoamer, a fragrance, and combinations thereof.
62. The method of any one of embodiments 48 to 61, wherein the second application pressure of at least about 30 psi during the dry end fabric cleaning step. The second application pressure may be 30 psi or any value above 30 psi, in increments of 0.1 psi, for example, 35.1 psi, or any range of values above 30 psi to, for example, about 6000 psi, in increments of 0.1 psi, for example, from about 365.0 to about 589.0 psi (or from about 30.0 psi to about 50.0 psi, or from about 250.0 psi to about 350.0 psi, or from about 2500.0 psi to about 4500.0 psi).
63. The method of any one of embodiments 48 to 62, wherein the second application pressure of from about 2500 psi to about 6000 psi during the dry end fabric cleaning step. The second application pressure may be any value between about 2500 psi to about 6000 psi, in increments of 0.1 psi, for example, 3520.1 psi, or any range of values between about 2500 psi to about 6000 psi, in increments of 0.1 psi, for example, from about 3653.0 to about 5890.0 psi, or from about 2500.0 psi to about 4500.0 psi, or from about 2500.0 psi to about 3500.0 psi).
64. The method of any one of embodiments 48 to 63, wherein the second cleaning composition is applied via one or more of: (i) stationery shower heads, (ii) oscillating shower heads, (iii) a traversing needle shower, or (iv) a combination of stationery shower heads, oscillating shower heads, and a traversing needle shower head.
65. The method of any one of embodiments 48 to 64, wherein the second cleaning composition is applied via one or more stationery shower heads.
66. The method of any one of embodiments 48 to 65, wherein the second cleaning composition is applied via one or more stationery shower heads during a dryer application shower cleaning step.
67. The method of any one of embodiments 48 to 66, wherein the second cleaning composition is applied via one or more oscillating shower heads.
68. The method of any one of embodiments 48 to 67, wherein the second cleaning composition is applied via one or more oscillating shower heads during a dryer oscillating shower cleaning step.
69. The method of any one of embodiments 48 to 68, wherein the second cleaning composition is applied via a traversing needle shower head.
70. The method of any one of embodiments 48 to 69, wherein the second cleaning composition is applied via a traversing needle shower during a dryer needle shower cleaning step.
71. The method of any one of embodiments 48 to 70, wherein the second cleaning composition is applied via a combination of stationery shower heads, oscillating shower heads, and a traversing needle shower head.
72. The method of any one of embodiments 40 to 58, wherein the second cleaning composition is applied at a second fluid feed rate that varies depending on (i) a basis weight of product 15 (e.g., paper or paper stock) moving along the dry end papermaking fabric 12, (ii) a line speed of the product 15 along the dry end papermaking fabric 12, or (iii) both the basis weight of the product 15 moving along the dry end papermaking fabric 12, and the line speed of the product 15 along the dry end papermaking fabric 12.
73. The method of any one of embodiments 48 to 72, wherein the second cleaning composition is applied via an on-the-fly batch cleaning step.
74. The method of any one of embodiments 48 to 73, wherein the second cleaning composition is applied via an on-the-fly continuous cleaning step.
75. The method of any one of embodiments 48 to 74, wherein said method eliminates a need for down batch cleanings during the dry end fabric cleaning step.
76. The method of any one of embodiments 1 to 30 and 48 to 75, wherein the first cleaning composition comprises: water and one or more aliphatic dibasic acid esters. In some embodiments, the one or more aliphatic dibasic acid esters comprise a blend of dimethyl glutarate, dimethyl adipate and dimethyl succinate. Commercially available blends include, but are not limited to, RHODIASOLV™ RPDE from Solvay Chemicals North America. In other embodiments, the one or more aliphatic dibasic acid esters may comprise other dibasic acid esters such as FlexaTrac™ DME-100 dimethyl ester and other commercially available esters from Ascend Performance Materials (Pensacola, Fla.), and FLEXISOLV® dibasic acid esters products and other commercially available esters from Invista (Wilmington, Del.).
77. The method of any one of embodiments 1 to 30 and 48 to 76, wherein the first cleaning composition comprises: one or more co-solvents (e.g., an alkylene carbonate, an alkyl fatty ester, methyl oleate, methyl soyate, or any combination thereof).
78. The method of any one of embodiments 1 to 30 and 48 to 77, wherein the first cleaning composition comprises: one or more co-solvents comprising propylene carbonate.
79. The method of any one of embodiments 1 to 30 and 48 to 78, wherein the first cleaning composition comprises: at least one glycol (e.g., neopentyl glycol or a dipropylene glycol). In some desired embodiments, the at least one glycol comprises dipropylene glycol.

80. The method of any one of embodiments 1 to 30 and 48 to 79, wherein the first cleaning composition comprises: one or more aromatic alcohols (e.g., benzyl alcohol).

81. The method of any one of embodiments 1 to 30 and 48 to 80, wherein the first cleaning composition comprises: one or more surfactants comprising $C_8$-$C_{12}$ linear alkoxylated alcohols. In some desired embodiments, the one or more $C_8$-$C_{12}$ linear alkoxylated alcohols comprise one or more $C_9$-$C_{11}$ linear alkoxylated alcohols having a desired degree of linearity (i.e., greater than 80%). Suitable $C_9$-$C_{11}$ linear alkoxylated alcohols include, but are not limited to, $C_9$-$C_{11}$ linear alkoxylated alcohols commercially available under the BEROL® trade designation such as BEROL® 266 surfactants, which comprise $C_9$-$C_{11}$ linear ethoxylated alcohols having 5.5 moles of ethylene oxide, a HLB (Hydrophile-Lipophile Balance) value of 12.1, two cloud points at 24-29° C. and 55-58° C., and less than 1.0 wt % unreacted alcohol.

82. The method of any one of embodiments 1 to 30 and 48 to 81, wherein the first cleaning composition comprises: one or more methyl soyates.

83. The method of any one of embodiments 1 to 30 and 48 to 82, wherein the first cleaning composition further comprises: a defoamer. Suitable defoamers include, but are not limited to, defoamers comprising linear alkoxylated fatty alcohols (e.g., $C_{10}$-$C_{22}$ linear alkoxylated fatty alcohols). Suitable defoamers include, but are not limited to, for example, SUPPRESSOR 1130 defoamer commercially available from Hydrite Chemical Company (Brookfield, Wis.).

84. The method of any one of embodiments 1 to 30 and 48 to 83, wherein the first cleaning composition further comprises: a dioctyl sulfosuccinate salt (e.g., dioctyl sulfosuccinate sodium salt (DOSS)).

85. The method of any one of embodiments 1 to 30, 48 to 77 and 79 to 81, wherein the first cleaning composition comprises: water, one or more aliphatic dibasic acid esters RHODIASOLV™ RDPE, methyl oleate, benzyl alcohol, dipropylene glycol, and one or more surfactants comprising $C_8$-$C_{12}$ linear alkoxylated alcohols (e.g., BEROL® 266 surfactant).

86. The method of any one of embodiments 1 to 30, 48 to 77, 79 to 81 and 83, wherein the first cleaning composition comprises: water, one or more aliphatic dibasic acid esters RHODIASOLV™ RDPE, methyl oleate, benzyl alcohol, dipropylene glycol, one or more surfactants comprising $C_8$-$C_{12}$ linear alkoxylated alcohols (e.g., BEROL® 266 surfactant), and a defoamer (e.g., SUPPRESSOR 1130 defoamer).

87. The method of any one of embodiments 1 to 30, 48 to 79 and 82, wherein the first cleaning composition comprises: water, one or more aliphatic dibasic acid esters, propylene carbonate, dipropylene glycol, and one or more methyl soyates.

88. The method of any one of embodiments 1 to 30, 48 to 75, and 78 to 81, wherein the first cleaning composition comprises: propylene carbonate, dipropylene glycol, benzyl alcohol, and one or more surfactants comprising $C_8$-$C_{12}$ linear alkoxylated alcohols (e.g., BEROL® 266 surfactant).

89. The method of any one of embodiments 1 to 30 and 48 to 88, wherein the first cleaning composition comprises water (A) and a first concentrate cleaning composition (B) at a A:B weight ratio (i.e., water to first concentrate cleaning composition) ranging from about 20:1 to about 120:1, said first concentrate cleaning composition (B) comprising: from about 5.0 to about 50.0 wt % of one or more aliphatic dibasic esters; from about 15.0 to about 50.0 wt % of one or more aromatic alcohols; from greater than 0.0 to about 20.0 wt % of one or more glycols (e.g., neopentyl glycol and/or dipropylene glycol); from greater than 0.0 to about 25.0 wt % of one or more co-solvents (e.g., an alkyl fatty ester such as methyl oleate); and from greater than 0.0 to about 5.0 wt % of one or more surfactants comprising $C_9$-$C_{11}$ linear alkoxylated alcohols; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %). (Note, this applies to all A:B weight ratio ranges and all weight percent ranges described in the present invention.)

90. The method of any one of embodiments 1 to 30 and 48 to 89, wherein the first cleaning composition comprises water (A) and a first concentrate cleaning composition (B) at a A:B weight ratio (i.e., water to first concentrate cleaning composition) ranging from about 20:1 to about 120:1, said first concentrate cleaning composition (B) comprising: from about 5.0 to about 30.0 wt % of one or more aliphatic dibasic esters; from about 20.0 to about 40.0 wt % of one or more aromatic alcohols; from greater than 0.0 to about 15.0 wt % of one or more glycols (e.g., neopentyl glycol and/or dipropylene glycol); from greater than 0.0 to about 5.0 wt % of one or more alkyl fatty esters (e.g., methyl oleate); from greater than 0.0 to about 5.0 wt % of one or more surfactants comprising $C_9$-$C_{11}$ linear alkoxylated alcohols; from 0.0 to about 5.0 wt % of one or more defoamers; and from about 25.0 to about 60.0 wt % of water; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

91. The method of any one of embodiments 1 to 30 and 48 to 90, wherein the first cleaning composition comprises water (A) and a first concentrate cleaning composition (B) at a A:B weight ratio (i.e., water to first concentrate cleaning composition) ranging from about 20:1 to about 120:1, said first concentrate cleaning composition (B) comprising: from about 5.0 to about 30.0 wt % of one or more aliphatic dibasic esters; from about 15.0 to about 50.0 wt % of one or more aromatic alcohols (e.g., benzyl alcohol); from greater than 0.0 to about 15.0 wt % of one or more glycols (e.g., neopentyl glycol and/or dipropylene glycol); from greater than 0.0 to about 20.0 wt % of one or more co-solvents (e.g., an alkyl fatty ester such as methyl oleate); from greater than 0.0 to about 5.0 wt % of one or more surfactants comprising $C_9$-$C_{11}$ linear alkoxylated alcohols; from 0.0 to about 5.0 wt % of one or more defoamers; and from about 70.0 to about 95.0 wt % of water; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

92. The method of any one of embodiments 1 to 30 and 48 to 91, wherein the first cleaning composition comprises water (A) and a first concentrate cleaning composition (B) at a A:B weight ratio (i.e., water to first concentrate cleaning composition) ranging from about 20:1 to about 120:1, said first concentrate cleaning composition (B) comprising: from about 5.0 to about 30.0 wt % of one or more aliphatic dibasic esters; from about 20.0 to about 50.0 wt % of one or more aromatic alcohols; from greater than 0.0 to about 5.0 wt % of one or more glycols (e.g., neopentyl glycol and/or dipropylene glycol); from greater than 0.0 to about 5.0 wt % of one or more alkyl fatty esters (e.g., methyl oleate); from greater than 0.0 to about 5.0 wt % of one or more surfactants comprising $C_9$-$C_{11}$ linear alkoxylated alcohols; from 0.0 to about 5.0 wt % of one or more defoamers; and from about 40.0 to about 95.0 wt % of water; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

93. The method of any one of embodiments 1 to 30 and 48 to 92, wherein the first cleaning composition comprises water (A) and a first concentrate cleaning composition (B) at a A:B weight ratio (i.e., water to first concentrate cleaning composition) ranging from about 20:1 to about 60:1, said first concentrate cleaning composition (B) comprising: from about 10.0 to about 40.0 wt % of one or more aliphatic dibasic esters; from about 5.0 to about 20.0 wt % of one or more alkylene carbonates (e.g., propylene carbonate); from greater than 0.0 to about 6.0 wt % of one or more methyl soyates; from greater than 0.0 to about 5.0 wt % of one or more glycols (e.g., neopentyl glycol and/or dipropylene glycol); and from about 45.0 to about 75.0 wt % of water; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

94. The method of any one of embodiments 1 to 30 and 48 to 93, wherein the first cleaning composition comprises water (A) and a first concentrate cleaning composition (B) at a A:B weight ratio (i.e., water to first concentrate cleaning composition) ranging from about 30:1 to about 50:1, said first concentrate cleaning composition (B) comprising: from about 22.0 to about 30.0 wt % of one or more aliphatic dibasic esters; from about 7.0 to about 13.0 wt % of one or more alkylene carbonates (e.g., propylene carbonate); from about 1.5 to about 4.5 wt % of one or more methyl soyates; from about 1.0 to about 3.0 wt % of one or more glycols (e.g., neopentyl glycol and/or dipropylene glycol); and from about 55.0 to about 65.0 wt % of water; wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

95. The method of any one of embodiments 1 to 30 and 48 to 94, wherein the first cleaning composition comprises water (A) and a first concentrate cleaning composition (B) at a A:B weight ratio (i.e., water to first concentrate cleaning composition) ranging from about 40:1 to about 120:1, said first concentrate cleaning composition (B) comprising: from about 65.0 to about 95.0 wt % of one or more alkylene carbonates (e.g., propylene carbonate); from greater than 0.0 to about 10.0 wt % of one or more glycols (e.g., neopentyl glycol and/or dipropylene glycol); from about 4.0 to about 15.0 wt % of one or more aromatic alcohols (e.g., benzyl alcohol); and from greater than 0.0 to about 5.0 wt % of one or more surfactants comprising $C_8$-$C_{12}$ linear alkoxylated alcohols (e.g., BEROL® 266 surfactant); wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 40:1, 41:1, 42:1 . . . 119:1, and 120:1) for the A:B weight ratio, and (ii) 0.01 for any weight percent (e.g., 0.01, 0.02, 0.03 . . . 9.98, 9.99 and 10.00 wt %).

96. The method of any one of embodiments 1 to 30 and 48 to 95, wherein the first cleaning composition comprises water (A) and a first concentrate cleaning composition (B) at a A:B weight ratio (i.e., water to first concentrate cleaning composition) ranging from about 70:1 to about 90:1, said first concentrate cleaning composition (B) comprising: from about 80.0 to about 90.0 wt % of one or more alkylene carbonates (e.g., propylene carbonate); from about 3.0 to about 7.0 wt % of one or more glycols (e.g., neopentyl glycol and/or dipropylene glycol); from about 6.0 to about 10.0 wt % of one or more aromatic alcohols (e.g., benzyl alcohol); and from about 1.0 to about 3.0 wt % of one or more surfactants comprising $C_8$-$C_{12}$ linear alkoxylated alcohols (e.g., BEROL® 266 surfactant); wherein all weight percents are based on a total weight of the first concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 40:1, 41:1, 42:1 . . . 119:1, and 120:1) for the A:B weight ratio, and (ii) 0.01 for any weight percent (e.g., 0.01, 0.02, 0.03 . . . 9.98, 9.99 and 10.00 wt %).

97. The method of any one of embodiments 31 to 96, wherein the second cleaning composition comprises: water and one or more aliphatic dibasic acid esters. In some embodiments, the one or more aliphatic dibasic acid esters comprise a blend of dimethyl glutarate, dimethyl adipate and dimethyl succinate. Commercially available blends include, but are not limited to, RHODIASOLV™ RPDE from Solvay Chemicals North America. As discussed above, the one or more aliphatic dibasic acid esters may comprise other dibasic acid esters such as Flexa-Trac™ DME-100 dimethyl ester and other commercially available esters from Ascend Performance Materials (Pensacola, Fla.), and FLEXISOLV® dibasic acid esters products and other commercially available esters from Invista (Wilmington, Del.).

98. The method of any one of embodiments 31 to 97, wherein the second cleaning composition further comprises: a defoamer. Suitable defoamers include, but are not limited to, defoamers comprising linear alkoxylated fatty alcohols (e.g., $C_{10}$-$C_{22}$ linear alkoxylated fatty alcohols). Suitable defoamers include, but are not limited to, for example, SUPPRESSOR 1130 defoamer commercially available from Hydrite Chemical Company (Brookfield, Wis.).

99. The method of any one of embodiments 31 to 98, wherein the second cleaning composition further comprises: one or more surfactants comprising $C_9$-$C_{11}$ linear alkoxylated alcohols (e.g., BEROL® 266 surfactant).

100. The method of any one of embodiments 31 to 99, wherein the second cleaning composition further comprises: a glycol (e.g., neopentyl glycol or a dipropylene glycol).

101. The method of any one of embodiments 31 to 100, wherein the second cleaning composition further comprises: one or more aromatic alcohols (e.g., benzyl alcohol).

102. The method of any one of embodiments 31 to 101, wherein the second cleaning composition further comprises: one or more co-solvents (e.g., an alkyl fatty ester, an alkylene carbonate such as propylene carbonate, a methyl soyate, methyl oleate, or any combination thereof).

103. The method of any one of embodiments 31 to 102, wherein the second cleaning composition further comprises: one or more alkyl fatty esters (e.g., methyl oleate).

104. The method of any one of embodiments 31 to 103, wherein the second cleaning composition further comprises: one or more alkylene carbonates (e.g., propylene carbonate).

105. The method of any one of embodiments 31 to 104, wherein the second cleaning composition further comprises: one or more methyl soyates.

106. The method of any one of embodiments 31 to 103, wherein the second cleaning composition comprises: water, one or more aliphatic dibasic acid esters (e.g., RHODIASOLV™ RDPE), a defoamer (e.g., SUPPRESSOR 1130 defoamer), a glycol comprising dipropylene glycol, one or more surfactants comprising $C_9$-$C_{11}$ linear alkoxylated alcohols (e.g., BEROL® 266 surfactant), one or more aromatic alcohols (e.g., benzyl alcohol), and one or more alkyl fatty esters (e.g., methyl oleate).

107. The method of any one of embodiments 31 to 97, 100 and 104 to 105, wherein the second cleaning composition comprises: water, one or more aliphatic dibasic acid esters (e.g., RHODIASOLV™ RDPE), a glycol comprising dipropylene glycol, one or more alkylene carbonates (e.g., propylene carbonate), and one or more methyl soyates.

108. The method of any one of embodiments 31 to 96, 99 to 101 and 104, wherein the second cleaning composition comprises: one or more surfactants comprising $C_8$-$C_{12}$ linear alkoxylated alcohols (e.g., BEROL® 266 surfactant), one or more aromatic alcohols (e.g., benzyl alcohol), a glycol comprising dipropylene glycol, and one or more alkylene carbonates (e.g., propylene carbonate).

109. The method of any one of embodiments 31 to 108, wherein the second cleaning composition comprises water (A) and a second concentrate cleaning composition (B) at a A:B weight ratio (i.e., water to second concentrate cleaning composition) ranging from about 20:1 to about 120:1, said second concentrate cleaning composition (B) comprising: from about 5.0 to about 30.0 wt % of one or more aliphatic dibasic esters (e.g., RHODIASOLV™ RDPE); from about 20.0 to about 50.0 wt % of one or more aromatic alcohols (e.g., benzyl alcohol); from greater than 0.0 to about 5.0 wt % of one or more glycols (e.g., neopentyl glycol and/or dipropylene glycol); from greater than 0.0 to about 5.0 wt % of one or more co-solvents (e.g., an alkylene carbonate such as propylene carbonate); from greater than 0.0 to about 5.0 wt % of one or more surfactants comprising $C_9$-$C_{11}$ linear alkoxylated alcohols (e.g., BEROL® 266 surfactant); from 0.0 to about 5.0 wt % of one or more defoamers (e.g., SUPPRESSOR 1130 defoamer); and from about 25.0 to about 60.0 wt % of water; wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

110. The method of any one of embodiments 31 to 109, wherein the second cleaning composition comprises water (A) and a second concentrate cleaning composition (B) at a A:B weight ratio (i.e., water to second concentrate cleaning composition) ranging from about 20:1 to about 120:1, said second concentrate cleaning composition (B) comprising: from about 5.0 to about 30.0 wt % of one or more aliphatic dibasic esters; from about 1.0 to about 50.0 wt % of one or more aromatic alcohols; from greater than 0.0 to about 10.0 wt % of one or more glycols (e.g., neopentyl glycol and/or dipropylene glycol); from greater than 0.0 to about 95.0 wt % of one or more alkyl fatty esters (e.g., methyl oleate); from greater than 0.0 to about 5.0 wt % of one or more surfactants comprising $C_9$-$C_{11}$ linear alkoxylated alcohols (e.g., BEROL® 266 surfactant); from greater than 0.0 to about 5.0 wt % of one or more defoamers (e.g., SUPPRESSOR 1130 defoamer); and from about 25.0 to about 70.0 wt % of water; wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

111. The method of any one of embodiments 31 to 110, wherein the second cleaning composition comprises water (A) and a second concentrate cleaning composition (B) at a A:B weight ratio (i.e., water to second concentrate cleaning composition) ranging from about 20:1 to about 60:1, said second concentrate cleaning composition (B) comprising: from about 10.0 to about 40.0 wt % of one or more aliphatic dibasic esters; from about 5.0 to about 20.0 wt % of one or more alkylene carbonates (e.g., propylene carbonate); from greater than 0.0 to about 6.0 wt % of one or more methyl soyates; from greater than 0.0 to about 5.0 wt % of one or more glycols (e.g., neopentyl glycol and/or dipropylene glycol); and from about 45.0 to about 75.0 wt % of water; wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

112. The method of any one of embodiments 31 to 111, wherein the second cleaning composition comprises water (A) and a second concentrate cleaning composition (B) at a A:B weight ratio (i.e., water to second concentrate cleaning composition) ranging from about 30:1 to about 50:1, said second concentrate cleaning composition (B) comprising: from about 22.0 to about 30.0 wt % of one or more aliphatic dibasic esters; from about 7.0 to about 13.0 wt % of one or more alkylene carbonates (e.g., propylene carbonate); from about 1.5 to about 4.5 wt % of one or more methyl soyates; from about 1.0 to about 3.0 wt % of one or more glycols (e.g., neopentyl glycol and/or dipropylene glycol); and from about 55.0 to about 65.0 wt % of water; wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 21:1, 22:1, 23:1 . . . 119:1, and 120:1) for the A:B weight ratio, and (ii) 0.01 for any weight percent (e.g., 5.01, 5.02, 5.03 . . . 49.98, 49.99 and 50.00 wt %).

113. The method of any one of embodiments 31 to 112, wherein the second cleaning composition comprises water (A) and a second concentrate cleaning composition (B) at a A:B weight ratio (i.e., water to second concentrate cleaning composition) ranging from about 40:1 to about 120:1, said first concentrate cleaning composition (B) comprising: from about 65.0 to about 95.0 wt % of one or more alkylene carbonates (e.g., propylene carbonate); from greater than 0.0 to about 10.0 wt % of one or more glycols (e.g., neopentyl glycol and/or dipropylene glycol); from about 4.0 to about 15.0 wt % of one or more aromatic alcohols (e.g., benzyl alcohol); and from greater than 0.0 to about 5.0 wt % of one or more surfactants comprising $C_8$-$C_{12}$ linear alkoxylated alcohols (e.g., BEROL® 266 surfactant); wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 40:1, 41:1, 42:1 . . . 119:1, and 120:1) for the A:B weight ratio, and (ii) 0.01 for any weight percent (e.g., 0.01, 0.02, 0.03 . . . 9.98, 9.99 and 10.00 wt %).

114. The method of any one of embodiments 31 to 113, wherein the second cleaning composition comprises water (A) and a second concentrate cleaning composition (B) at a A:B weight ratio (i.e., water to second concentrate cleaning composition) ranging from about 70:1 to about 90:1, said first concentrate cleaning composition (B) comprising: from about 80.0 to about 90.0 wt % of one or more alkylene carbonates (e.g., propylene carbonate); from about 3.0 to about 7.0 wt % of one or more glycols (e.g., neopentyl glycol and/or dipropylene glycol); from about 6.0 to about 10.0 wt % of one or more aromatic alcohols (e.g., benzyl alcohol); and from about 1.0 to about 3.0 wt % of one or more surfactants comprising $C_8$-$C_{12}$ linear alkoxylated alcohols (e.g., BEROL® 266 surfactant); wherein all weight percents are based on a total weight of the second concentrate cleaning composition. It should be noted that (i) for any A:B weight ratio and for any (ii) weight range provided above, a given (i) A:B weight ratio or (ii) weight range includes each end point and any value or range of values between the end points, in increments of (i) 1:1 (e.g., 40:1, 41:1, 42:1 . . . 119:1, and 120:1) for the A:B weight ratio, and (ii) 0.01 for any weight percent (e.g., 0.01, 0.02, 0.03 . . . 9.98, 9.99 and 10.00 wt %).

115. The method of any one of embodiments 14 to 114, wherein the first cleaning composition and the second cleaning composition comprise the same cleaning composition.

116. The method of any one of embodiments 1 to 100, wherein the method is capable of removing contaminants used to make paper products from the one or more papermaking fabrics 11/12.

Methods of Making Paper

117. A method of making paper, said method comprising the method of any one of embodiments 1 to 116.

118. Use of the method of any one of embodiments 1 to 116 to make paper.

Paper

119. Paper made using the method of any one of embodiments 1 to 117 or the use of embodiment 118.

Cleaning Compositions for Cleaning Paper Making Fabrics

120. A cleaning composition, wherein said cleaning composition comprises any cleaning composition (e.g., the first cleaning composition or the second cleaning composition) recited in any one of method embodiments 1 to 117 or the use embodiment 118 or the examples below.

121. The cleaning composition of embodiment 120, wherein said cleaning composition comprises a concentrate cleaning composition comprising: one or more alkylene carbonates (e.g., propylene carbonate), a glycol (e.g., dipropylene glycol), and at least one of: (i) one or more aromatic alcohols (e.g., benzyl alcohol), (ii) one or more aliphatic dibasic acid esters, and (iii) one or more methyl soyates. As used herein, the phrase "concentrate cleaning composition" (or "first concentrate cleaning composition" or "second concentrate cleaning composition") refers to a cleaning composition that can be used as is, but is typically diluted with water to form a use cleaning combination, e.g., the first cleaning composition and the second cleaning composition discussed throughout embodiments 1 to 118 above.

122. The cleaning composition of embodiment 120 or 121, wherein said cleaning composition comprises a concentrate cleaning composition comprising: water, one or more aliphatic dibasic acid esters, propylene carbonate, dipropylene glycol, and one or more methyl soyates.

123. The cleaning composition of any one of embodiments 120 to 122, wherein said cleaning composition comprises a concentrate cleaning composition comprising: from about 5.0 to about 40.0 wt % (or any value between about 5.0 and about 40.0 wt %, in increments of 0.1 wt %, for example, 21.2 wt %, or any range of values between about 5.0 and about 40.0 wt %, in increments of 0.1 wt %, for example, from about 8.5 to about 32.8 wt %) of one or more aliphatic dibasic esters (e.g., RHODIASOLV™ RPDE); from greater than 5.0 to about 25.0 wt % (or any value between about 5.0 and about 25.0 wt %, in increments of 0.1 wt %, for example, 9.6 wt %, or any range of values between about 5.0 and about 25.0 wt %, in increments of 0.1 wt %, for example, from about 8.5 to about 9.7 wt %) of propylene carbonate; from greater than 0.0 to about 15.0 wt % (or any value between about 0.1 and about 15.0 wt %, in increments of 0.1 wt %, for example, 0.2 wt %, or any range of values between about 0.1 and about 15.0 wt %, in increments of 0.1 wt %, for example, from about 2.5 to about 3.8 wt %) of one or more methyl soyates; from greater than 0.0 to about 8.0 wt % (or any value between about 0.1 and about 8.0 wt %, in increments of 0.1 wt %, for example, 1.6 wt %, or any range of values between about 0.1 and about 8.0 wt %, in increments of 0.1 wt %, for example, from about 1.5 to about 2.8 wt %) of dipropylene glycol; and from greater than 40.0 to about 80.0 wt % (or any value between about 40.0 and about 80.0 wt %, in increments of 0.1 wt %, for example, 51.2 wt %, or any range of values between about 40.0 and about 80.0 wt %, in increments of 0.1 wt %, for example, from about 56.5 to about 62.8 wt %) of water; wherein all weight percents are based on a total weight of the cleaning composition.

124. The cleaning composition of any one of embodiments 120 to 123, wherein said cleaning composition comprises a concentrate cleaning composition comprising: about 26.0 wt % of one or more aliphatic dibasic esters (e.g., RHODIASOLV™ RDPE); about 10.0 wt % of propylene carbonate; about 3.0 wt % of one or more methyl soyates; about 2.0 wt % of dipropylene glycol; and about 59.0 wt % of water; wherein all weight percents are based on a total weight of the cleaning composition.

125. The cleaning composition of embodiment 123 or 124, wherein said cleaning composition comprises: water (A) and said concentrate cleaning composition (B) at a A:B weight ratio (i.e., water to said concentrate cleaning composition) ranging from about 20:1 to about 60:1 (or any ratio between about 20:1 and about 60:1, in increments of 1:1, for example, 28:1, or any range of values between about 20:1 and about 60:1, in increments of 1:1, for example, from about 32:1 to about 53:1).

126. The cleaning composition of any one of embodiments 123 to 125, wherein said cleaning composition comprises: water (A) and said concentrate cleaning composition (B) at a A:B weight ratio (i.e., water to said concentrate cleaning composition) ranging from about 40:1 to about 50:1.

127. The cleaning composition of embodiment 120 or 121, wherein said cleaning composition comprises a concentrate cleaning composition comprising: propylene carbonate, dipropylene glycol, benzyl alcohol, and one or more surfactants comprising $C_8$-$C_{12}$ linear alkoxylated alcohols (e.g., BEROL® 266 surfactant).

128. The cleaning composition of any one of embodiments 120 to 121 and 127, wherein said cleaning composition comprises a concentrate cleaning composition comprising: from greater than 70.0 to about 95.0 wt % (or any value between about 70.0 and about 95.0 wt %, in increments of 0.1 wt %, for example, 81.2 wt %, or any range of values between about 70.0 and about 95.0 wt %, in increments of 0.1 wt %, for example, from about 76.5 to about 92.8 wt %) of propylene carbonate; from greater than 0.0 to about 15.0 wt % (or any value between about 0.1 and about 15.0 wt %, in increments of 0.1 wt %, for example, 11.6 wt %, or any range of values between about 0.1 and about 15.0 wt %, in increments of 0.1 wt %, for example, from about 0.8 to about 9.8 wt %) of benzyl alcohol; from greater than 0.0 to about 8.0 wt % (or any value between about 0.1 and about 8.0 wt %, in increments of 0.1 wt %, for example, 5.2 wt %, or any range of values between about 0.1 and about 8.0 wt %, in increments of 0.1 wt %, for example, from about 1.5 to about 2.8 wt %) of dipropylene glycol; and from greater than 0.0 to about 5.0 wt % (or any value between about 0.1 and about 5.0 wt %, in increments of 0.1 wt %, for example, 1.2 wt %, or any range of values between about 0.1 and about 5.0 wt %, in increments of 0.1 wt %, for example, from about 1.5 to about 2.6 wt %) of one or more surfactants comprising $C_9$-$C_{11}$ linear alkoxylated alcohols (e.g., BEROL® 266 SA surfactant); wherein all weight percents are based on a total weight of the cleaning composition.

129. The cleaning composition of any one of embodiments 120 to 121 and 127 to 128, wherein said cleaning composition comprises a concentrate cleaning composition comprising: about 85% propylene carbonate; about 8.0 wt % benzyl alcohol; about 5.0 wt % dipropylene glycol; and about 2.0 wt % of one or more surfactants comprising $C_9$-$C_{11}$ linear alkoxylated alcohols (e.g., BEROL® 266 SA surfactant); wherein all weight percents are based on a total weight of the cleaning composition.

130. The cleaning composition of embodiment 128 or 129, wherein said cleaning composition comprises: water (A) and said concentrate cleaning composition (B) at a A:B weight ratio (i.e., water to said concentrate cleaning composition) ranging from about 40:1 to about 120:1 (or any ratio between about 40:1 and about 120:1, in increments of 1:1, for example, 118:1, or any range of values between about 40:1 and about 120:1, in increments of 1:1, for example, from about 70:1 to about 83:1).

131. The cleaning composition of any one of any one of embodiments 128 to 130, wherein said cleaning composition comprises: water (A) and said concentrate cleaning composition (B) at a A:B weight ratio (i.e., water to said concentrate cleaning composition) ranging from about 70:1 to about 90:1.

In addition, it should be understood that although the above-described methods of cleaning one or more papermaking fabrics and cleaning compositions (e.g., first and second cleaning compositions, concentrate cleaning compositions, and use cleaning compositions) are described as "comprising" one or more method steps or composition components, the above-described methods and compositions may "comprise," "consists of," or "consist essentially of" the above-described method steps or composition components. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, methods of cleaning one or more papermaking fabrics and/or cleaning compositions that "comprises" a list of elements (e.g., method steps or composition components) is not necessarily limited to only those elements (method steps or composition components), but may include other elements (method steps or composition components) not expressly listed or inherent to the methods or compositions.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a method step or composition that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

The present invention is described above and further illustrated below by way of examples, which are not to be construed in any way as imposing limitations upon the scope of the invention. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

Example 1—Preparation of Paper Making Fabric Cleaning Compositions

Preparation of Base Compositions:

A first base fabric cleaning composition, referred to herein as "Base 1," was prepared using the components as shown in the Table 1 below.

TABLE 1

Base 1 Fabric Cleaning Composition

| Component | Wt. % | Source |
|---|---|---|
| Benzyl Alcohol | 23.00 | LanXess (Simpsonville, SC) |
| RPDE ester blend | 46.00 | Solvay Chemicals North America (Houston, TX) |
| Methyl oleate | 15.00 | Sigma Aldrich (St. Louis, MO) |
| Dipropylene glycol | 12.00 | Dow Chemical (Midland, MI) |
| BEROL ™ 266 SA surfactant | 3.00 | AkzoNobel (Amsterdam) |

A second base fabric cleaning composition, referred to herein as "Base 2," was prepared using the components as shown in the Table 2 below.

TABLE 2

Base 2 Fabric Cleaning Composition

| Component | Wt. % | Source |
|---|---|---|
| dipropylene glycol | 39.00 | Dow Chemical (Midland, MI) |
| methyl oleate | 50.00 | Sigma Aldrich (St. Louis, MO) |
| BEROL ™ 266 SA surfactant | 10.00 | AkzoNobel (Amsterdam) |
| SUPPRESSOR ™ 1130 defoamer | 1.00 | Hydrite Chemical Company (Brookfield, WI) |

A third base fabric cleaning composition, referred to herein as "Base 3," was prepared using the components as shown in the Table 3 below.

TABLE 3

Base 3 Fabric Cleaning Composition

| Component | Wt. % | Source |
|---|---|---|
| RPDE ester blend | 26.00 | Solvay Chemicals North America (Houston, TX) |
| Propylene carbonate | 10.00 | Huntsman Corporation (The Woodland, TX) |
| SOYENOL ™ 1000 methyl soyate | 3.00 | Soy Technologies, LLC (Nicholasville, KY) |
| dipropylene glycol | 2.00 | Dow Chemical (Midland, MI) |
| water | 59.00 | municipal |

A fourth base fabric cleaning composition, referred to herein as "Base 4," was prepared using the components as shown in the Table 4 below.

TABLE 4

Base 4 Fabric Cleaning Composition

| Component | Wt. % | Source |
|---|---|---|
| Benzyl Alcohol | 8.00 | LanXess (Simpsonville, SC) |
| Propylene carbonate | 85.00 | Huntsman Corporation (The Woodland, TX) |
| dipropylene glycol | 5.00 | Dow Chemical (Midland, MI) |
| BEROL ™ 266 SA surfactant | 2.00 | AkzoNobel (Amsterdam) |

Preparation of Cleaning Compositions:

A first fabric cleaning composition, referred to herein as "Composition 1A," was prepared using the components as shown in the Table 5 below.

TABLE 5

Cleaning Composition 1A Components and Weight Percent Ranges

| Component | Wt. % Range | Preferred Wt. % | Source |
|---|---|---|---|
| RPDE ester blend | about 5.00 to about 25.00 | about 15.00 | Solvay Chemicals North America (Houston, TX) |
| Benzyl Alcohol | about 25.00 to about 50.00 | about 35.00 | Sigma Aldrich (St. Louis, MO) |
| Base 1 (from Table 1) | about 1.00 to about 15.00 | about 9.00 | |
| SUPPRESSOR ™ 1130 defoamer | about 0.50 to about 5.00 | about 1.00 | Hydrite Chemical Company (Brookfield, WI) |

TABLE 5-continued

| Cleaning Composition 1A Components and Weight Percent Ranges | | | |
|---|---|---|---|
| Component | Wt. % Range | Preferred Wt. % | Source |
| water | about 25.00 to about 50.00 | about 40.00 | municipal |

Composition 1A was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step. Composition 1A was found to be especially useful in each of the following cleaning steps described above: (1) the wet application shower cleaning step, (2) the wet oscillating shower cleaning step, (3) the dryer application shower cleaning step, and (5) the dryer needle shower cleaning step.

A second fabric cleaning composition, referred to herein as "Composition 1B," was prepared using the components as shown in the Table 6 below.

TABLE 6

| Cleaning Composition 1B Components and Weight Percent Ranges | | | |
|---|---|---|---|
| Component | Wt. % Range | Preferred Wt. % | Source |
| RPDE ester blend | about 5.00 to about 25.00 | about 15.00 | Solvay Chemicals North America (Houston, TX) |
| Benzyl Alcohol | about 25.00 to about 50.00 | about 35.00 | Sigma Aldrich (St. Louis, MO) |
| Base 2 (from Table 2) | about 1.00 to about 15.00 | about 8.00 | — |
| SUPPRESSOR ™ 1130 defoamer | about 0.50 to about 5.00 | about 1.00 | Hydrite Chemical Company (Brookfield, WI) |
| water | about 30.00 to about 50.00 | about 40.00 | municipal |

Composition 1B was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step. Composition 1B was found to be especially useful in each of the following cleaning steps described above: (1) the wet application shower cleaning step, (2) the wet oscillating shower cleaning step, (3) the dryer application shower cleaning step, and (5) the dryer needle shower cleaning step.

A third fabric cleaning composition, referred to herein as "Composition 2A," was prepared using the components as shown in the Table 7 below.

TABLE 7

| Cleaning Composition 2A Components and Weight Percent Ranges | | | |
|---|---|---|---|
| Component | Wt. % Range | Preferred Wt. % | Source |
| RPDE ester blend | about 5.00 to about 25.00 | about 10.00 | Solvay Chemicals North America (Houston, TX) |
| Base 1 (from Table 1) | about 1.00 to about 15.00 | about 2.00 | — |

TABLE 7-continued

| Cleaning Composition 2A Components and Weight Percent Ranges | | | |
|---|---|---|---|
| Component | Wt. % Range | Preferred Wt. % | Source |
| SUPPRESSOR ™ 1130 defoamer | about 1.00 to about 5.00 | about 3.00 | Hydrite Chemical Company (Brookfield, WI) |
| water | about 70.00 to about 95.00 | about 85.00 | municipal |

Composition 2A was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step. Composition 2A was found to be especially useful in each of the following cleaning steps described above: (2) the wet oscillating shower cleaning step, and (5) the dryer needle shower cleaning step.

A fourth fabric cleaning composition, referred to herein as "Composition 2B," was prepared using the components as shown in the Table 8 below.

TABLE 8

| Cleaning Composition 2B Components and Weight Percent Ranges | | | |
|---|---|---|---|
| Component | Wt. % Range | Preferred Wt. % | Source |
| RPDE ester blend | about 5.00 to about 25.00 | about 10.00 | Solvay Chemicals North America (Houston, TX) |
| Base 2 (from Table 2) | about 1.00 to about 15.00 | about 2.00 | — |
| SUPPRESSOR ™ 1130 defoamer | about 1.00 to about 5.00 | about 3.00 | Hydrite Chemical Company (Brookfield, WI) |
| water | about 70.00 to about 95.00 | about 85.00 | municipal |

Composition 2B was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step. Composition 2B was found to be especially useful in each of the following cleaning steps described above: (2) the wet oscillating shower cleaning step, and (5) the dryer needle shower cleaning step.

A fifth fabric cleaning composition, referred to herein as "Composition 3A," was prepared using the components as shown in the Table 9 below.

TABLE 9

| Cleaning Composition 3A Components and Weight Percent Ranges | | | |
|---|---|---|---|
| Component | Wt. % Range | Preferred Wt. % | Source |
| Base 3 (from Table 3) | about 1.00 | about 1.00 | — |
| water | about 20.00 to about 60.00 | about 40.00 to about 50.00 | municipal |

Composition 3A was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step.

A sixth fabric cleaning composition, referred to herein as "Composition 3B," was prepared using the components as shown in the Table 10 below.

TABLE 10

Cleaning Composition 3B Components and Weight Percent Ranges

| Component | Wt. % Range | Preferred Wt. % | Source |
|---|---|---|---|
| Base 4 (from Table 4) | about 1.00 | about 1.00 | — |
| water | about 40.00 to about 120.00 | about 70.00 to about 90.00 | municipal |

Composition 3B was found to be suitable for use in each of the following cleaning steps described above: (1) the wet application shower cleaning step, (2) the wet oscillating shower cleaning step, (3) the dryer application shower cleaning step, (4) the dryer oscillating shower cleaning step, and (5) the dryer needle shower cleaning step.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A cleaning composition suitable for use in a method of cleaning papermaking fabrics, said cleaning composition comprising a concentrate cleaning composition comprising:
- one or more alkylene carbonates,
- dipropylene glycol,
- one or more aromatic alcohols, and
- one or more surfactants.

2. The cleaning composition of claim 1, wherein the cleaning composition comprises:
- propylene carbonate,
- dipropylene glycol,
- benzyl alcohol, and
- one or more surfactants comprising $C_8$-$C_{12}$ linear alkoxylated alcohols.

3. The cleaning composition of claim 2, wherein the one or more surfactants comprising $C_8$-$C_{12}$ linear alkoxylated alcohols comprises $C_9$-$C_{11}$ linear ethoxylated alcohols having 5.5 moles of ethylene oxide.

4. The cleaning composition of claim 2, further comprising methyl oleate.

5. The cleaning composition of claim 1, wherein the cleaning composition comprises:
- one or more alkylene carbonates,
- dipropylene glycol,
- one or more aromatic alcohols,
- one or more aliphatic dibasic acid esters, and
- one or more surfactants.

6. The cleaning composition of claim 3, wherein the one or more aliphatic dibasic acid esters comprise a blend of dimethyl glutarate, dimethyl adipate and dimethyl succinate.

7. The cleaning composition of claim 1, wherein the cleaning composition comprises: water (A) and the concentrate cleaning composition (B) at a A:B weight ratio ranging from about 20:1 to about 60:1.

8. The cleaning composition of claim 1, wherein the cleaning composition comprises: water (A) and a concentrate cleaning composition (B) at a A:B weight ratio ranging from about 40:1 to about 120:1, the concentrate cleaning composition (B) comprising:
- from about 65.0 to about 95.0 wt % of one or more alkylene carbonates;
- from greater than 0.0 to about 10.0 wt % dipropylene glycol;
- from about 4.0 to about 15.0 wt % of one or more aromatic alcohols; and
- from greater than 0.0 to about 5.0 wt % of one or more surfactants comprising $C_8$-$C_{12}$ linear alkoxylated alcohols;
- wherein all weight percents are based on a total weight of the concentrate cleaning composition.

9. The cleaning composition of claim 1, wherein the cleaning composition comprises:
- from about 5.0 to about 40.0 wt % of one or more aliphatic dibasic esters;
- from greater than 5.0 to about 25.0 wt % of propylene carbonate;
- from greater than 0.0 to about 8.0 wt % of dipropylene glycol; and
- from greater than 40.0 to about 80.0 wt % of water;
- wherein all weight percents are based on a total weight of the cleaning composition.

10. The cleaning composition of claim 1, wherein the cleaning composition comprises:
- about 85% propylene carbonate;
- about 8.0 wt % benzyl alcohol;
- about 5.0 wt % dipropylene glycol; and
- about 2.0 wt % of one or more surfactants comprising $C_9$-$C_{11}$ linear alkoxylated alcohols;
- wherein all weight percents are based on a total weight of the cleaning composition.

11. The cleaning composition of claim 1, wherein the cleaning composition is a pH near neutral chemical composition, having a composition pH ranging from about 6.5 to about 7.5.

12. A concentrate cleaning composition comprising:
- from about 65.0 to about 95.0 wt % of propylene carbonate;
- from greater than 0.0 to about 10.0 wt % of dipropylene glycol;
- from about 4.0 to about 15.0 wt % of benzyl alcohol; and
- from greater than 0.0 to about 5.0 wt % of the one or more surfactants comprising $C_8$-$C_{12}$ linear alkoxylated alcohols;
- wherein all weight percents are based on a total weight of the concentrate cleaning composition.

13. The concentrate cleaning composition of claim 12, wherein the one or more surfactants comprising $C_8$-$C_{12}$ linear alkoxylated alcohols comprises $C_9$-$C_{11}$ linear ethoxylated alcohols having 5.5 moles of ethylene oxide.

14. A cleaning composition comprising: water (A) and the concentrate cleaning composition (B) of claim 12, wherein the water (A) and the concentrate cleaning composition (B) are present at a A:B weight ratio ranging from about 40:1 to about 120:1.

15. A cleaning composition suitable for use in a method of cleaning papermaking fabrics, said cleaning composition consisting of a concentrate cleaning composition consisting of:

propylene carbonate,
dipropylene glycol,
benzyl alcohol, and
one or more surfactants.

16. The cleaning composition of claim 15, wherein the one or more surfactants consist of one or more $C_8$-$C_{12}$ linear alkoxylated alcohols.

17. The cleaning composition of claim 15, wherein the cleaning composition consist of:

from about 65.0 to about 95.0 wt % of propylene carbonate;

from greater than 0.0 to about 10.0 wt % of dipropylene glycol;

from about 4.0 to about 15.0 wt % of benzyl alcohol; and from greater than 0.0 to about 5.0 wt % of the one or more surfactants selected from the group consisting of $C_8$-$C_{12}$ linear alkoxylated alcohols, wherein all weight percents are based on a total weight of the cleaning composition.

18. A cleaning composition consisting of the cleaning composition of claim 17 diluted with water.

19. The cleaning composition of claim 15, wherein the cleaning composition consist of:

about 85% propylene carbonate;

about 8.0 wt % benzyl alcohol;

about 5.0 wt % dipropylene glycol; and about 2.0 wt % of one or more surfactants comprising $C_9$-$C_{11}$ linear alkoxylated alcohols;

wherein all weight percents are based on a total weight of the cleaning composition.

20. A cleaning composition consisting of the cleaning composition of claim 15 diluted with water.

* * * * *